US011261655B2

(12) United States Patent
Huang et al.

(10) Patent No.: US 11,261,655 B2
(45) Date of Patent: Mar. 1, 2022

(54) WINDOW SHADE AND SPRING DRIVE SYSTEM THEREOF

(71) Applicant: Teh Yor Co., Ltd., New Taipei (TW)

(72) Inventors: Chin-Tien Huang, New Taipei (TW); Chien-Fong Huang, City of Industry, CA (US)

(73) Assignee: Teh Yor Co., Ltd., New Taipei (TW)

( * ) Notice: Subject to any disclaimer, the term of this patent is extended or adjusted under 35 U.S.C. 154(b) by 253 days.

(21) Appl. No.: 16/683,115

(22) Filed: Nov. 13, 2019

(65) Prior Publication Data

US 2020/0370368 A1 Nov. 26, 2020

Related U.S. Application Data

(60) Provisional application No. 62/851,992, filed on May 23, 2019.

(51) Int. Cl.
*E06B 9/322* (2006.01)
*E06B 9/323* (2006.01)
(Continued)

(52) U.S. Cl.
CPC ..... *E06B 9/322* (2013.01); *E06B 9/323* (2013.01); *E06B 9/324* (2013.01); *E06B 9/262* (2013.01);
(Continued)

(58) Field of Classification Search
CPC ... E06B 9/322; E06B 9/324; E06B 2009/3222
See application file for complete search history.

(56) References Cited

U.S. PATENT DOCUMENTS 6,601,635 B2 * 8/2003 Ciuca ..... E06B 9/32 160/170
6,761,203 B1 * 7/2004 Huang ..... E06B 9/322 160/170
(Continued)

FOREIGN PATENT DOCUMENTS

CN 109695411 A 4/2019

OTHER PUBLICATIONS

International Search Report in the parent PCT application No. PCT/US2019/061296, dated Apr. 3, 2020.
(Continued)

*Primary Examiner* — Johnnie A. Shablack
(74) *Attorney, Agent, or Firm* — Chen Yoshimura LLP

(57) ABSTRACT

A spring drive system for a window shade includes a housing, a first and a second gear engaged with each other and respectively assembled about a first and a second pivot axis, two springs respectively assembled at two opposite sides of the second gear and respectively connected with two take-up reels provided on the first gear, a first cord drum and a third gear fixedly connected with each other and assembled about a third pivot axis, the first and third gears being respectively located at different levels along the first and third pivot axes and respectively engaged with a first gear train, a second cord drum and a fourth gear fixedly connected with each other and assembled about a fourth pivot axis, the second and fourth gears being respectively located at different levels along the second and fourth pivot axes and respectively engaged with a second gear train.

20 Claims, 16 Drawing Sheets

(51) Int. Cl.
*E06B 9/324* (2006.01)
*E06B 9/262* (2006.01)
*E06B 9/28* (2006.01)

(52) U.S. Cl.
CPC . *E06B 2009/285* (2013.01); *E06B 2009/3222* (2013.01)

(56) References Cited

U.S. PATENT DOCUMENTS 7,406,995 B2 * 8/2008 Huang ..... E06B 9/322 160/170
7,717,154 B2 * 5/2010 Cheng ..... E06B 9/322 160/170
8,297,332 B2 * 10/2012 Lin ..... E06B 9/322 160/170
9,797,189 B2 * 10/2017 Huang ..... E06B 9/384
9,976,345 B2 * 5/2018 Chen ..... E06B 9/322
10,273,748 B2 * 4/2019 Chen ..... E06B 9/322
10,273,749 B2 * 4/2019 Lei ..... B65H 75/4415
10,329,836 B2 * 6/2019 Lin ..... E06B 9/322
10,494,862 B2 * 12/2019 Zhang ..... E06B 9/32
10,731,409 B2 * 8/2020 Chen ..... E06B 9/322
2007/0227677 A1 * 10/2007 Yu ..... E06B 9/322 160/170
2008/0185109 A1 * 8/2008 Lin ..... E06B 9/262 160/170
2010/0206492 A1 * 8/2010 Shevick ..... E06B 9/30 160/170
2011/0061823 A1 * 3/2011 Lin ..... E06B 9/262 160/340
2011/0290429 A1 * 12/2011 Cheng ..... E06B 9/322 160/84.02
2012/0032019 A1 * 2/2012 Chen ..... E06B 9/322 242/378
2013/0032300 A1 * 2/2013 Yu ..... E06B 9/322 160/84.02
2014/0083631 A1 * 3/2014 Huang ..... E06B 9/80 160/170
2015/0129142 A1 * 5/2015 Huang ..... E06B 9/262 160/370
2016/0123071 A1 * 5/2016 Huang ..... E06B 9/322 160/170
2016/0298385 A1 * 10/2016 Chen ..... E06B 9/324
2017/0067287 A1 * 3/2017 Chen ..... E06B 9/322
2017/0298688 A1 * 10/2017 Chen ..... F03G 1/00
2018/0230739 A1 * 8/2018 Huang ..... E06B 9/262
2019/0093426 A1 3/2019 Huang et al.

OTHER PUBLICATIONS

Written Opinion in the parent PCT application No. PCT/US2019/061296, dated Apr. 3, 2020.

* cited by examiner

200

200A

WINDOW SHADE AND SPRING DRIVE SYSTEM THEREOF

CROSS-REFERENCE TO RELATED APPLICATION(S)

This application claims priority to U.S. provisional patent application No. 62/851,992 filed on May 23, 2019, the disclosure of which is incorporated herein by reference.

BACKGROUND

1. Field of the Invention

The present invention relates to window shades, and spring drive systems used in window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be manually actuated to raise or lower a bottom rail of the window shade. The bottom rail can be raised by winding a suspension member around a rotary drum, and lowered by unwinding the suspension member from the rotary drum.

However, there have been concerns that the operating cord of the window shade may pose strangulation risks to children. As a result, cordless window shades have been developed, which use electric motors or spring motors to raise and lower the bottom rail. Spring motors used in window shades generally consist of springs that are operable to apply a torque for keeping the bottom rail at a desired height. However, the conventional constructions of the spring motors may not be easily adapted to different sizes or types of window shades.

Therefore, there is a need for an improved spring drive system that can be conveniently used in window shades and address at least the foregoing issues.

SUMMARY

The present application describes a window shade and a spring drive system for use with the window shade. In one embodiment, the spring drive system includes a housing, a first and a second gear respectively connected pivotally with the housing about a first and a second pivot axis and engaged with each other, the first gear being fixedly connected with a first and a second take-up reel at two opposite sides of the first gear, a first and a second spring respectively assembled at two opposite sides of the second gear around the second pivot axis, the first spring having an end anchored with the first take-up reel and the second spring having an end anchored with the second take-up reel, a first cord drum and a third gear fixedly connected with each other and pivotally connected with the housing about a third pivot axis, the first cord drum being connected with a first suspension cord, a first gear train respectively engaged with the first gear and the third gear, the first gear and the third gear being respectively located at different levels along the first and third pivot axes, a second cord drum and a fourth gear fixedly connected with each other and pivotally connected with the housing about a fourth pivot axis, the second cord drum being connected with a second suspension cord, and a second gear train respectively engaged with the second gear and the fourth gear, the second gear and the fourth gear being respectively located at different levels along the second and fourth pivot axes.

According to another embodiment, a spring drive system for use with a window shade includes a housing; a first and a second gear respectively connected pivotally with the housing about a first and a second pivot axis, the first and second gears being engaged with each other, the first gear being fixedly connected with a first and a second take-up reel at two opposite sides of the first gear; a first and a second spring respectively assembled at two opposite sides of the second gear around the second pivot axis, the first spring having an end anchored with the first take-up reel, and the second spring having an end anchored with the second take-up reel; a first cord drum and a third gear fixedly connected with each other and pivotally connected with the housing about a third pivot axis, the first cord drum being connected with a first suspension cord and having a winding surface where the first suspension cord is wound that extends between two axially opposite protruding edges of the first cord drum, the first and second gears being located within an extent of the winding surface between the two protruding edges; a first gear train respectively engaged with the first gear and the third gear; a second cord drum and a fourth gear fixedly connected with each other and pivotally connected with the housing about a fourth pivot axis, the second cord drum being connected with a second suspension cord; and a second gear train respectively engaged with the second gear and the fourth gear.

Moreover, the application describes different types of window shades that incorporate the spring drive system.

DETAILED DESCRIPTION OF THE EMBODIMENTS

Figure 1:
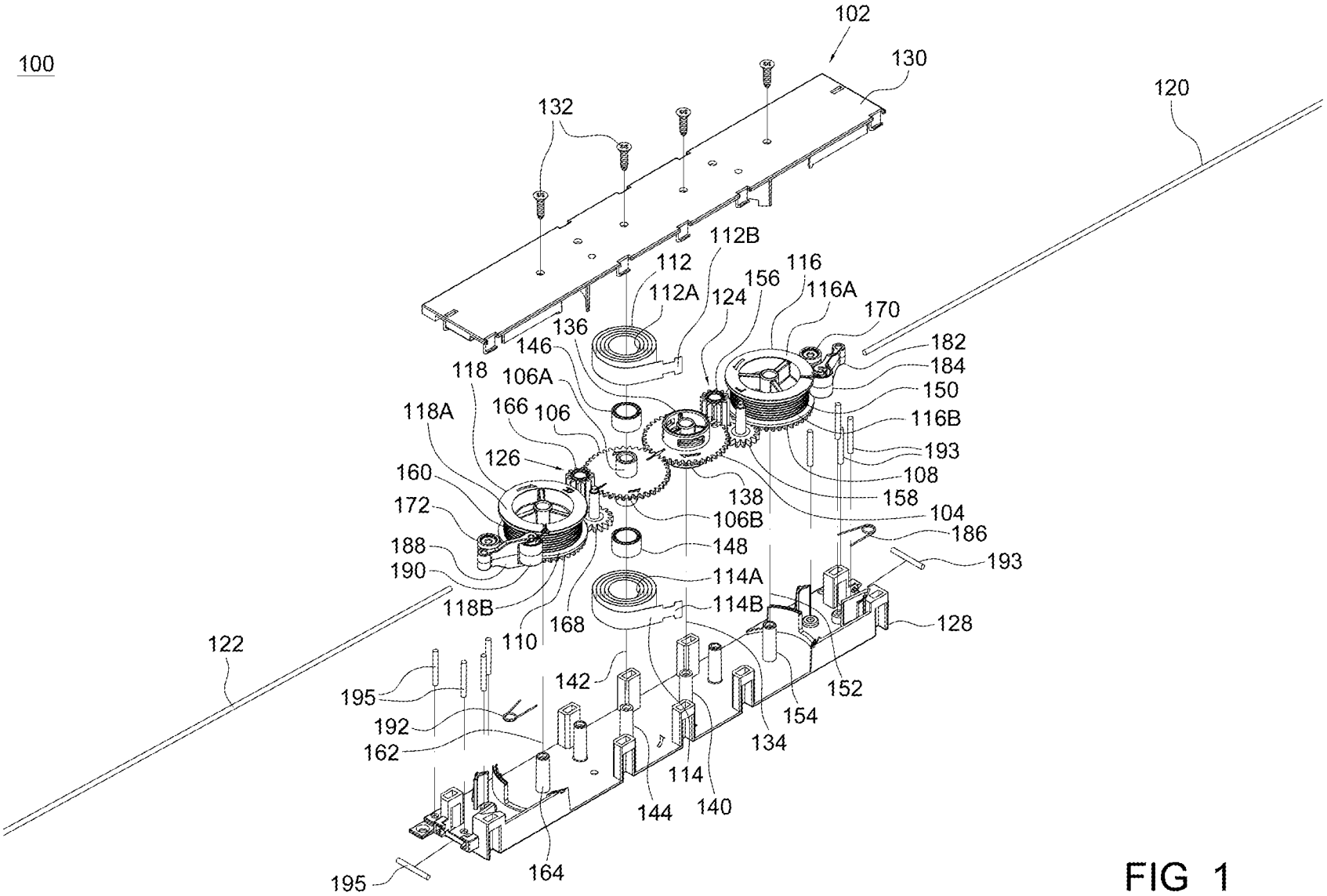
FIG. 1 is an exploded view illustrating an embodiment of a spring drive system for a window shade.
Figure 2:
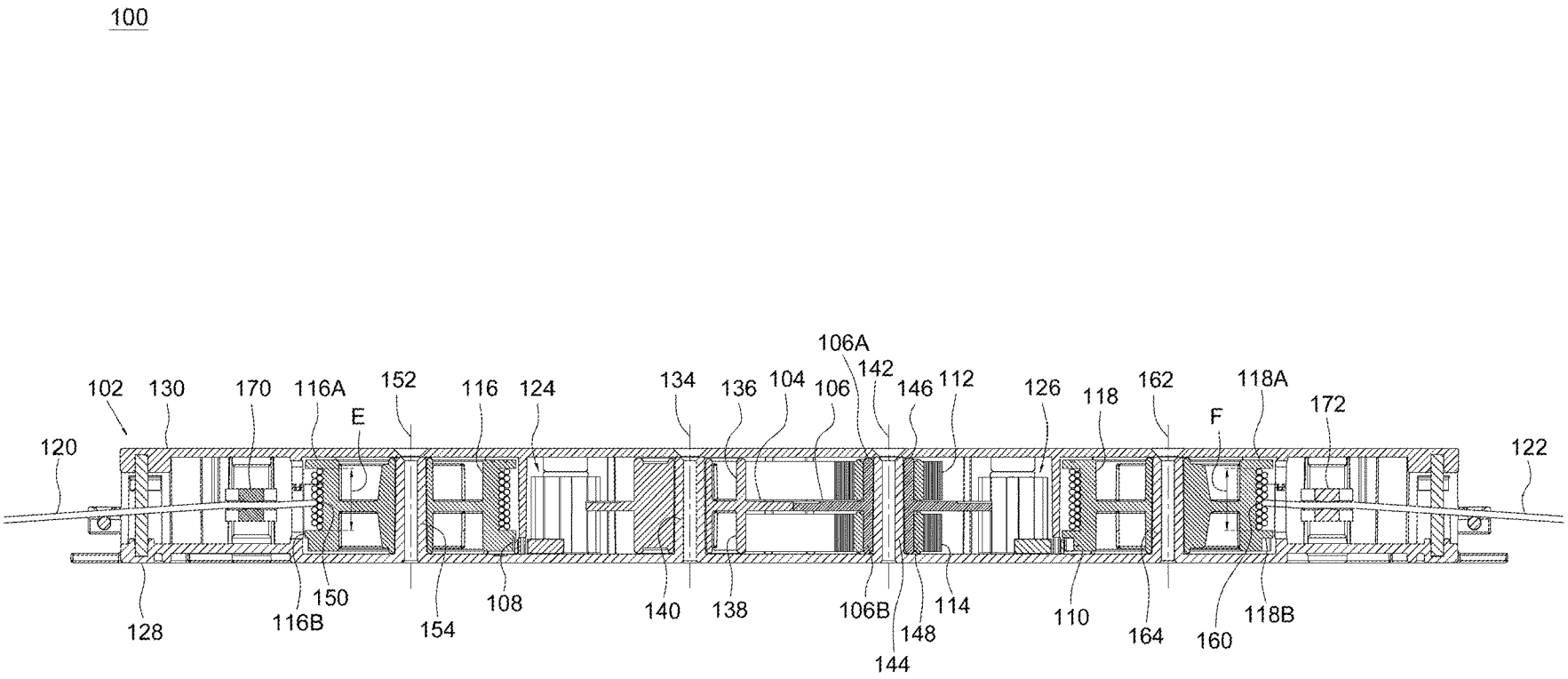
FIG. 2 is a cross-sectional view illustrating the spring drive system shown in FIG. 1.
Figure 3:
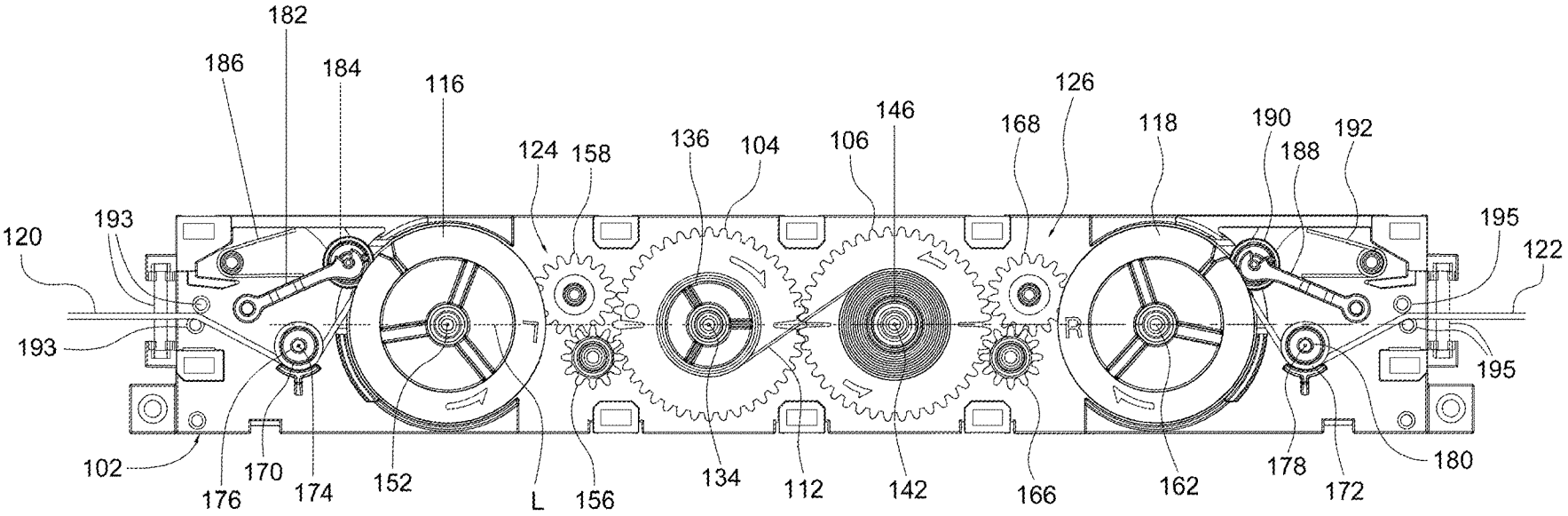
FIG. 3 is a planar view of the spring drive system shown in FIG. 1.
Figure 4:
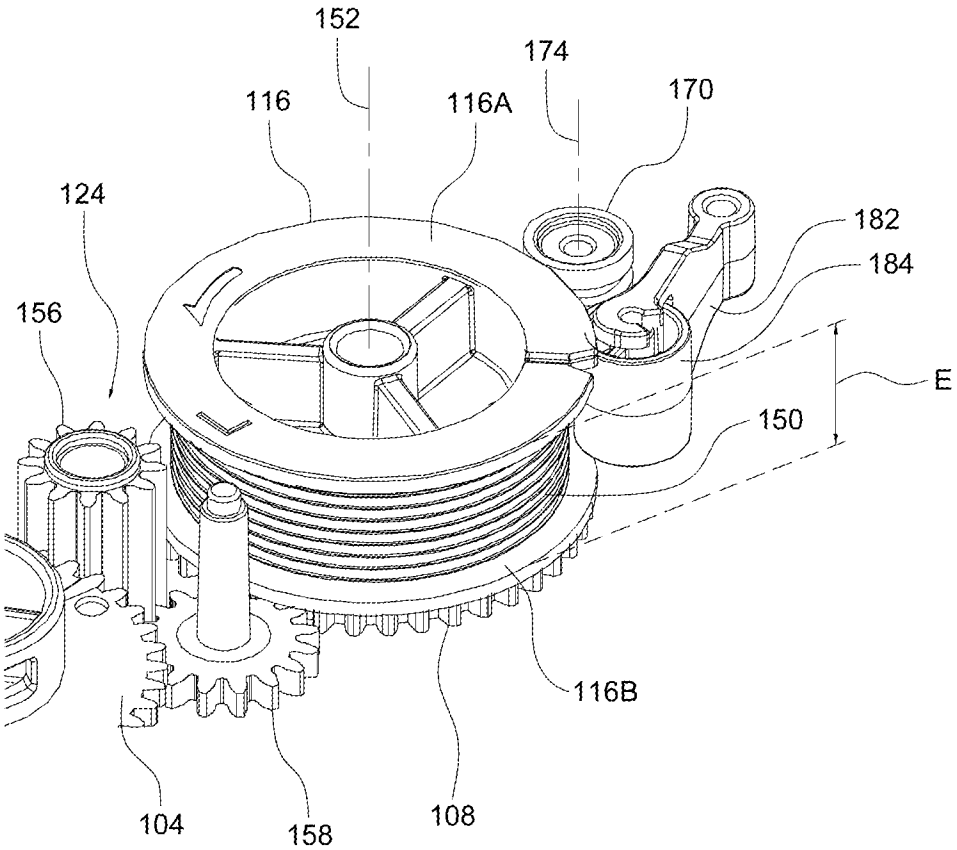
FIG. 4 is an enlarged view illustrating a portion of the spring drive system shown in FIG. 1.
Figure 5:
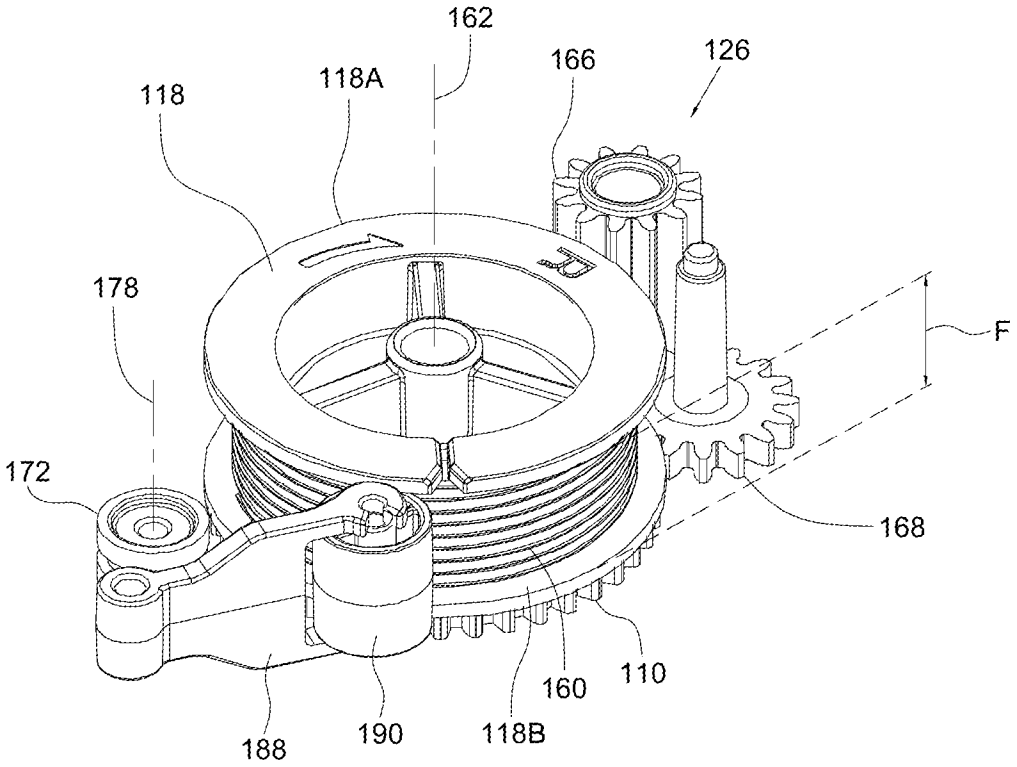
FIG. 5 is an enlarged view illustrating another portion of the spring drive system shown in FIG. 1.

FIG. 1 is an exploded view illustrating an embodiment of a spring drive system 100 for a window shade, FIG. 2 is a cross-sectional view of the spring drive system 100, FIG. 3 is a planar view of the spring drive system 100, and FIGS. 4 and 5 are enlarged views of two portions of the spring drive system 100 shown in FIG. 1. Referring to FIGS. 1-5, the spring drive system 100 includes a housing 102, four gears 104, 106, 108 and 110, two springs 112 and 114, two cord drums 116 and 118, two suspension cords 120 and 122 and two gear trains 124 and 126. According to an example of construction, the housing 102 can include two covers 128 and 130 that can be fixedly attached to each other via a plurality of screws 132. The gears 104, 106, 108 and 110, the springs 112 and 114, the cord drums 116 and 118 and the gear trains 124 and 126 can be disposed in an interior of the housing 102 delimited at least partially between the two covers 128 and 130.

The gear 104 is pivotally connected with the housing 102 about a pivot axis 134, and is fixedly connected with two take-up reels 136 and 138 at two opposite sides thereof. For example, the housing 102 can be fixedly connected with a shaft portion 140, and the gear 104 can be pivotally connected with the housing 102 at the shaft portion 140. The gear 104 and the two take-up reels 136 and 138 can be disposed in a coaxial manner, so that the gear 104 and the take-up reels 136 and 138 can rotate in unison relative to the housing 102 about the pivot axis 134.

The gear 106 is pivotally connected with the housing 102 about a pivot axis 142, and is engaged with the gear 104. For example, the housing 102 can be fixedly connected with a shaft portion 144, and the gear 106 can be pivotally connected with the housing 102 at the shaft portion 144. The gear 106 can be thereby rotationally coupled to the gear 104, and can rotate in either direction about the pivot axis 142 relative to the housing 102.

The two springs 112 and 114 can be coiled ribbon springs. The two springs 112 and 114 are respectively assembled coaxially around the pivot axis 142 at two opposite sides of the gear 106, and can be respectively connected with the take-up reels 136 and 138. According to an example of construction, the gear 106 can be fixedly connected with two shaft portions 106A and 106B protruding from two opposite sides of the gear 106 coaxial to the pivot axis 142, and two spring reels 146 and 148 can be respectively connected pivotally about the two shaft portions 106A and 106B at the two opposite sides of the gear 106, whereby the gear 106 and the spring reels 146 and 148 are disposed in a coaxial manner. The two spring reels 146 and 148 can thereby respectively rotate independently about the pivot axis 142 relative to the gear 106 and the housing 102. The spring 112 is assembled around the spring reel 146 with an end 112A of the spring 112 disposed adjacent to the spring reel 146 (e.g., there may be a contact or no contact between the end 112A of the spring 112 and the spring reel 146) and another end 112B of the spring 112 anchored with the take-up reel 136. Likewise, the spring 114 is assembled around the spring reel 148 with an end 114A of the spring 114 disposed adjacent to the spring reel 148 (e.g., there may be a contact or no contact between the end 114A of the spring 114 and the spring reel 148) and another end 114B of the spring 114 anchored with the take-up reel 138.

Referring to FIGS. 1-5, the cord drum 116 is connected with the suspension cord 120, and has a winding surface 150 for winding the suspension cord 120 that extends between two axially opposite protruding edges 116A and 116B of the cord drum 116. According to an example of construction, the winding surface 150 of the cord drum 116 may have a plurality of grooves for facilitating positioning and winding of the suspension cord 120. The cord drum 116 is fixedly connected with the gear 108 in a coaxial manner, and both the cord drum 116 and the gear 108 are pivotally connected with the housing 102 about a pivot axis 152. For example, the housing 102 can be fixedly connected with a shaft portion 154, and the cord drum 116 and the gear 108 can be pivotally connected with the housing 102 at the shaft portion 154. The cord drum 116 and the gear 108 can thereby rotate in unison about the pivot axis 152 relative to the housing 102 for winding and unwinding the suspension cord 120.

Referring to FIGS. 1-4, the take-up reels 136 and 138 are rotationally coupled to the cord drum 116 via the gear train 124, which is respectively engaged with the gears 104 and 108 so that the take-up reels 136 and 138 and the cord drum 116 rotate in different directions. According to an example of construction, the gears 104 and 108 and the gear train 124 can be configured so that the cord drum 116 and the take-up reels 136 and 138 have a same rotational speed, i.e., the take-up reels 136 and 138 rotate one turn when the cord drum 116 completes one turn. According to another example of construction, the gears 104 and 108 and the gear train 124 can be configured to impart a rotational speed difference between the cord drum 116 and the take-up reels 136 and 138. For example, the gears 104 and 108 and the gear train 124 may be configured so that the take-up reels 136 and 138 rotate less than one turn when the cord drum 116 completes one turn, i.e., the take-up reels 136 and 138 rotate slower than the cord drum 116. According to an example of construction, the gear train 124 can include two gears 156 and 158 engaged with each other, the gear 156 further being engaged with the gear 104, and the gear 158 further being engaged with the gear 108.

Referring to FIGS. 1-5, the cord drum 118 is connected with the suspension cord 122, and has a winding surface 160 for winding the suspension cord 122 that extends between two axially opposite protruding edges 118A and 118B of the cord drum 118. According to an example of construction, the winding surface 160 of the cord drum 118 may have a plurality of grooves for facilitating positioning and winding of the suspension cord 122. The cord drum 118 may be identical to the cord drum 116 in construction. The cord drum 118 is fixedly connected with the gear 110 in a coaxial manner, and both the cord drum 118 and the gear 110 are pivotally connected with the housing 102 about a pivot axis 162. For example, the housing 102 can be fixedly connected with a shaft portion 164, and the cord drum 118 and the gear 110 can be pivotally connected with the housing 102 at the shaft portion 164. The cord drum 118 and the gear 110 can thereby rotate in unison about the pivot axis 162 relative to the housing 102 for winding and unwinding the suspension cord 122.

Referring to FIGS. 1-3 and 5, the gear train 126 is respectively engaged with the gears 106 and 110 so that the take-up reels 136 and 138 are also rotationally coupled to the cord drums 116 and 118, wherein the gears 106 and 110 rotate in different directions. The configuration of the gears 106 and 110 and the gear train 126 can be symmetric to that of the gears 104 and 108 and the gear train 124. According to an example of construction, the gears 106 and 110 and the gear train 126 can be configured so that the cord drums 116 and 118 and the take-up reels 136 and 138 have a same rotational speed. According to another example of construction, the gears 106 and 110 and the gear train 126 can be configured so that the cord drums 116 and 118 have a same rotational speed and a rotational speed difference is imparted between the cord drums 116 and 118 and the take-up reels 136 and 138. For example, the gears 106 and 110 and the gear train 126 may be configured so that the take-up reels 136 and 138 rotate less than one turn when the cord drums 116 and 118 respectively complete one turn, i.e., the take-up reels 136 and 138 rotate slower than the cord drums 116 and 118. According to an example of construction, the gear train 126 can include two gears 166 and 168 engaged with each other, the gear 166 further being engaged with the gear 106, and the gear 168 further being engaged with the gear 110. The gear 166 of the gear train 126 can be identical to the gear 156 of the gear train 124, and the gear 168 of the gear train 126 can be identical to the gear 158 of the gear train 124.

In the spring drive system 100, the two springs 112 and 114 can respectively unwind from the two spring reels 146 and 148 and wind around the two take-up reels 136 and 138 when the two cord drums 116 and 118 rotate for unwinding the two suspension cords 120 and 122. Moreover, the two springs 112 and 114 can respectively unwind from the two take-up reels 136 and 138 and wind around the two spring reels 146 and 148 to urge the two cord drums 116 and 118 in rotation for winding the two suspension cords 120 and 122. The two spring reels 146 and 148 can facilitate unwinding and winding movements of the two springs 112 and 114, and would not necessarily move along with the springs 112 and 114.

Referring to FIGS. 1-5, the pivot axes 134, 142, 152 and 162 are all parallel to one another, and can be substantially aligned along a longitudinal axis L of the spring drive system 100. Moreover, the gears 104 and 108 are located at different levels along their respective pivot axes 134 and 152 and do not overlap each other. More specifically, the gear 104 can be located within an extent E of the winding surface 150 between the two protruding edges 116A and 116B of the cord drum 116, and the gear 108 can be disposed outside the extent E of the winding surface 150 and adjacent to the protruding edge 116B of the cord drum 116. For coupling the gears 104 and 108 positioned at different levels, the gears 156 and 158 of the gear train 124 may have different face widths, a face width of a gear being defined as the width of a tooth taken along the axis of the gear. For example, the face width of the gear 158 may be smaller than the face width of the gear 156. However, another alternative construction may have the face width of the gear 158 greater than the face width of the gear 156.

Likewise, the gears 106 and 110 are located at different levels along their respective pivot axes 142 and 162 and do not overlap each other. More specifically, the gear 106 can be located within an extent F of the winding surface 160 between the two protruding edges 118A and 118B of the cord drum 118, and the gear 110 can be disposed outside the extent F of the winding surface 160 and adjacent to the protruding edge 118B of the cord drum 118. Since the gears 104 and 106 are engaged with each other and are at a same level, the gears 104 and 106 can be likewise located within the extent E of the winding surface 150 of the cord drum 116 and within the extent F of the winding surface 160 of the cord drum 118. For coupling the gears 106 and 110 positioned at different levels, the gears 166 and 168 of the gear train 126 may have different face widths, e.g., the face width of the gear 168 may be smaller than the face width of the gear 166. In this manner, the spring drive system 100 can be more compact.

Figure 7:
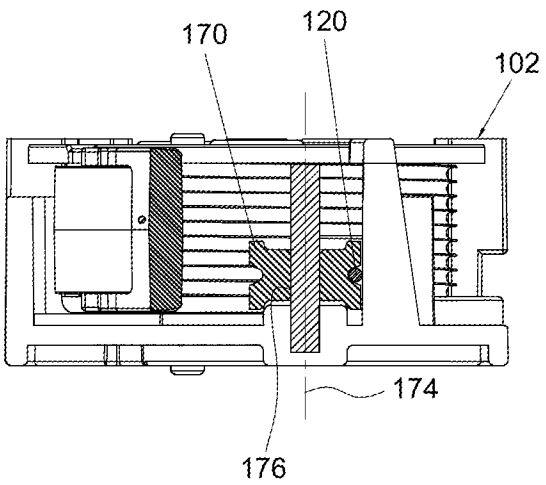
FIGS. 6 and 7 are schematic views illustrating exemplary sliding of a guide roller provided in the spring drive system shown in FIG. 1.
Figure 6:
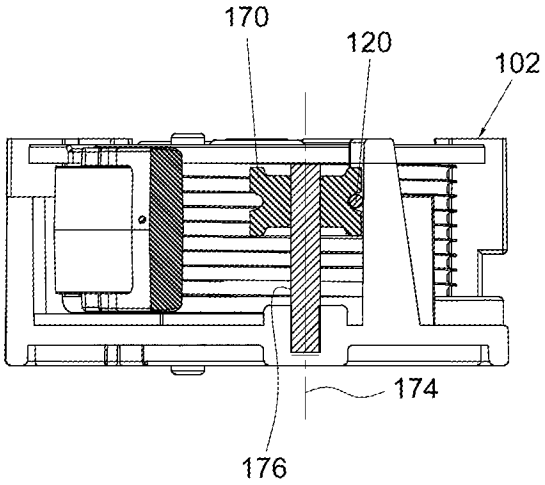

Referring to FIGS. 1-5, the spring drive system 100 can further include two guide rollers 170 and 172 respectively coupled to the two suspension cords 120 and 122. The guide roller 170 can be pivotally connected with the housing 102 about a pivot axis 174, and can be disposed so as to be slidable along the pivot axis 174. For example, the housing 102 may be fixedly connected with a shaft portion 176 that is located off the longitudinal axis L, and the guide roller 170 can be assembled so as to be rotatable around and slidable along the shaft portion 176. The suspension cord 120 can be routed so as to wrap at least partially around the guide roller 170 off the longitudinal axis L. As the cord drum 116 rotates for winding the suspension cord 120, the guide roller 170 can concurrently rotate about and slide along the pivot axis 174 so as to position the suspension cord 120 for uniform winding across the winding surface 150 of the cord drum 116 from one of the two protruding edges 116A and 116B toward the other one of the two protruding edges 116A and 116B. FIGS. 6 and 7 are schematic views illustrating exemplary sliding of the guide roller 170 along the shaft portion 176.

Likewise, the guide roller 172 can be pivotally connected with the housing 102 about a pivot axis 178, and can be disposed so as to be slidable along the pivot axis 178. For example, the housing 102 may be fixedly connected with a shaft portion 180 that is located off the longitudinal axis L, and the guide roller 172 can be assembled so as to be rotatable around and slidable along the shaft portion 180. The suspension cord 122 can be routed so as to wrap at least partially around the guide roller 172 off the longitudinal axis L. As the cord drum 118 rotates for winding the suspension cord 122, the guide roller 170 can concurrently rotate about and slide along the pivot axis 178 so as to position the suspension cord 122 for uniform winding across the winding surface 160 of the cord drum 118 from one of the two protruding edges 118A and 118B toward the other one of the two protruding edges 118A and 118B.

Referring to FIGS. 1-5, the spring drive system 100 can further include a rod 182 that is pivotally connected with the housing 102 and carries a roller 184 at one end, and a spring 186 respectively connected with the rod 182 and the housing 102. The spring 186 can bias the rod 182 in a direction that causes the roller 184 to contact and press the suspension cord 120 against the cord drum 116. Likewise, a rod 188 carrying a roller 190 at one end can be provided for pressing the suspension cord 122 against the cord drum 118. The rod 188 can be pivotally connected with the housing 102, and a spring 192 can be respectively connected with the rod 188 and the housing 102. The spring 192 can bias the rod 188 in a direction that causes the roller 190 to contact and press the suspension cord 122 against the cord drum 118.

Referring to FIGS. 1 and 3, the spring drive system 100 can further include a cord guide structure that can facilitate routing of the two suspension cords 120 and 122 inside the housing 102. For example, the cord guide structure can include a plurality of guide members 193 for the suspension cord 120, and a plurality of guide members 195 for the suspension cord 122. The guide members 193 and 195 can be connected with the housing 102, and exemplary include fixed shaft portions, pulleys, and the like. The suspension cord 120 can be routed in contact with the guide members 193, and the suspension cord 122 can be routed in contact with the guide members 195. The two suspension cords 120 and 122 may be routed so as to exit the housing 102 at two opposite ends thereof.

In conjunction with FIGS. 1-7, FIGS. 8-11 are schematic views illustrating an embodiment of a window shade 200 incorporating the spring drive system 100. The window shade 200 can be a cordless window shade. "Cordless window shade" as used herein means a window shade having no operating cord exposed for a user's operation. Referring to FIGS. 8-11, the window shade 200 can include a head rail 202, a shading structure 204, and a bottom part 206 disposed at a bottom of the shading structure 204. The head rail 202 may be of any types and shapes. The head rail 202 may be affixed at a top of a window frame, and the shading structure 204 and the bottom part 206 can be suspended from the head rail 202.

The shading structure 204 can have any suitable constructions. For example, the shading structure 204 can include a honeycomb structure made from a cloth material (as shown), a Venetian blind construction, or a plurality of slats distributed vertically and parallel to one another. The shading structure 204 can have two opposite ends 204A and 204B respectively disposed adjacent to the head rail 202 and the bottom part 206. For example, the shading structure 204 can have a honeycomb structure, and the end 204A of the shading structure 204 may be provided with a strip 208 that is engaged with the head rail 202 so as to attach the end 204A of the shading structure 204 to the head rail 202. Two end caps 210A and 210B may respectively close two opposite ends of the head rail 202 so as to restrain the strip 208 inside the head rail 202. Likewise, the end 204B of the shading structure 204 can be provided with a strip 212 that is engaged with the bottom part 206 so as to attach the end 204B of the shading structure 204 to the bottom part 206. Two end caps 214A and 214B may respectively close two opposite ends of the bottom part 206 so as to restrain the strip 212 inside the bottom part 206.

The bottom part 206 is movable vertically relative to the head rail 202 to expand and collapse the shading structure 204. According to an example of construction, the bottom part 206 may be formed as an elongated rail. The bottom part 206 may be fixedly connected with a handle 206A for facilitating its operation. Moreover, a weighing element 216 may be attached to the bottom part 206 to add stability as desired.

Figure 8:
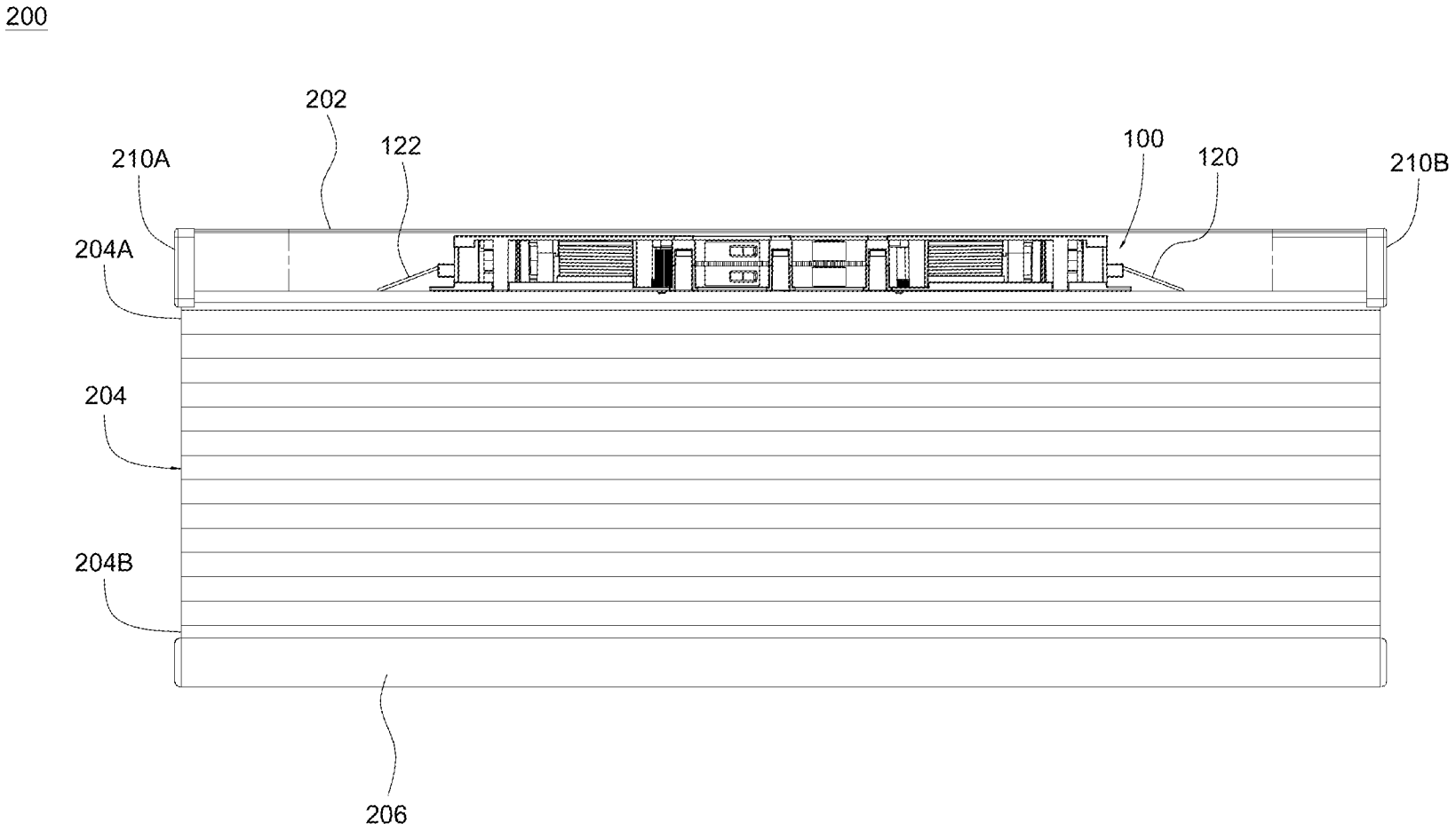
FIG. 8 is a front view illustrating an embodiment of a window shade incorporating the spring drive system shown in FIGS. 1-5.
Figure 9:
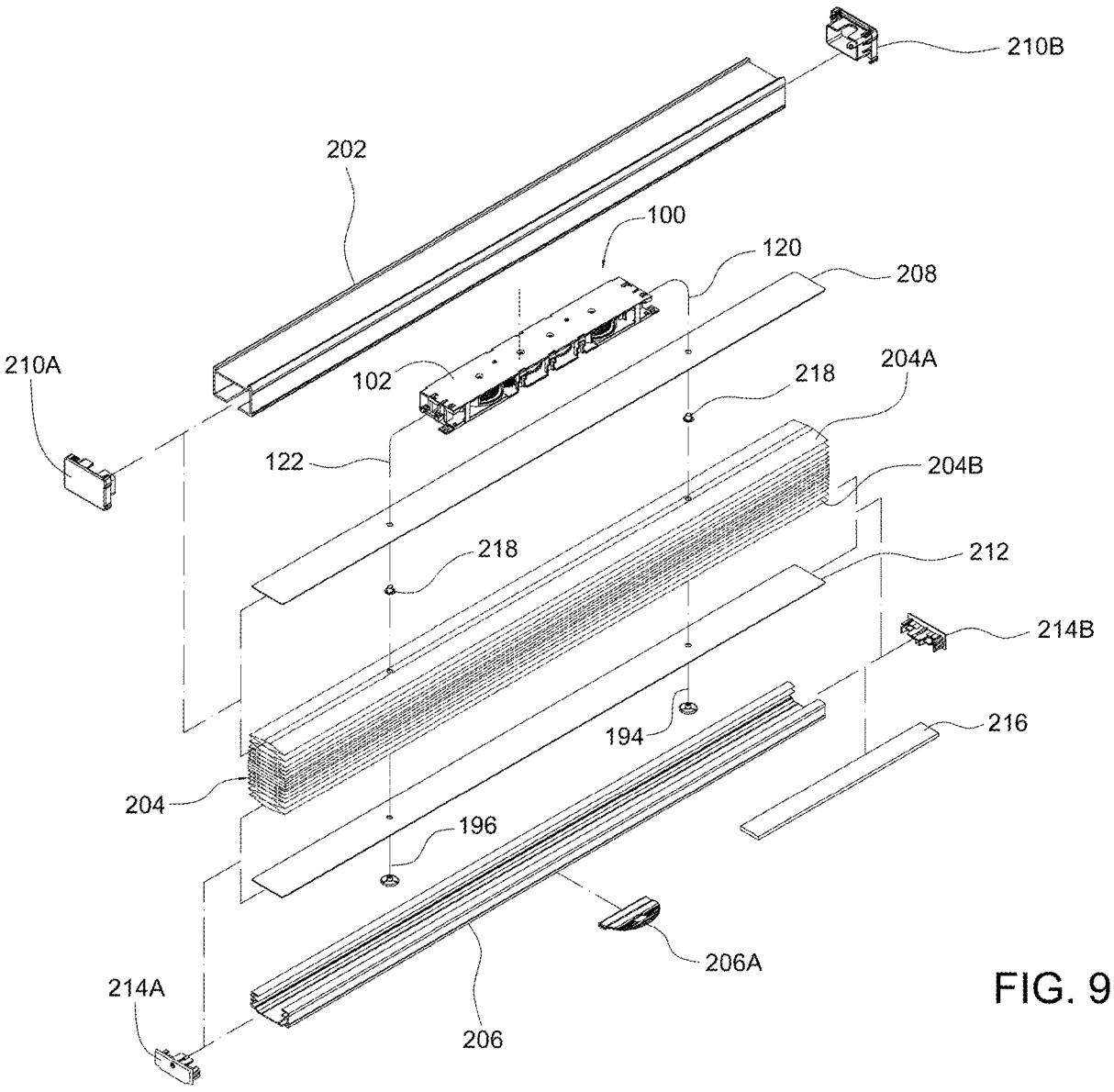
FIG. 9 is an exploded view of the window shade shown in FIG. 8.

Referring to FIGS. 8 and 9, the spring drive system 100 can be disposed in the head rail 202 or the bottom part 206 of the window shade 200, and can operate to sustain the shading structure 204 and the bottom part 206 at any desirable height. In the embodiment illustrated in FIGS. 8-11, the housing 102 of the spring drive system 100 can be exemplary affixed to the head rail 202, and the two suspension cords 120 and 122 can have respective distal ends 194 and 196 affixed to the bottom part 206. It would be appreciated, however, that the housing 102 of the spring drive system 100 may be alternatively affixed to the bottom part 206, and the respective distal ends 194 and 196 of the two suspension cords 120 and 122 may be affixed to the head rail 202. The shading structure 204 may include grommets 218 through which the suspension cords 120 and 122 may be routed for passage through the shading structure 204.

Figure 11:
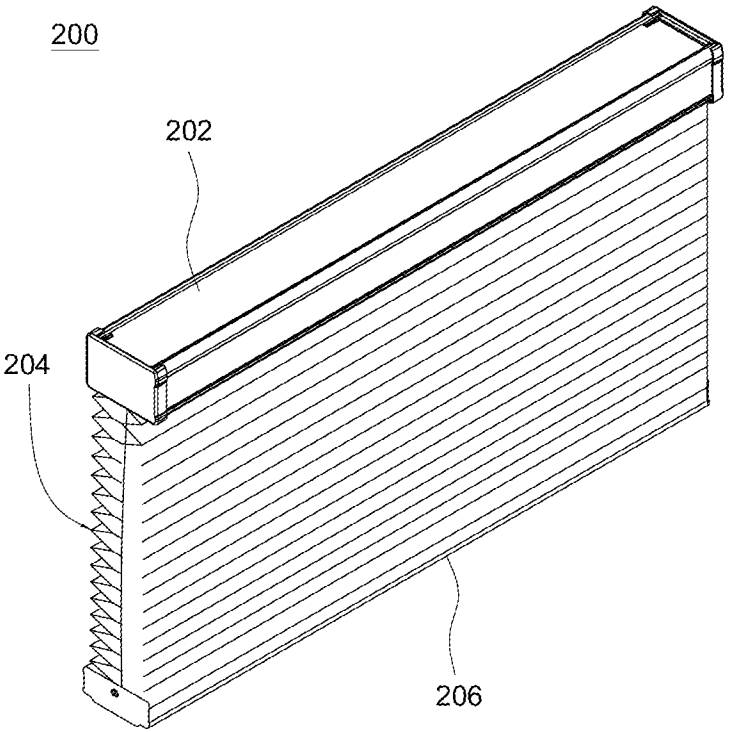
FIG. 11 is a perspective view illustrating the window shade of FIG. 8 with the bottom part held in a lowered position.
Figure 10:
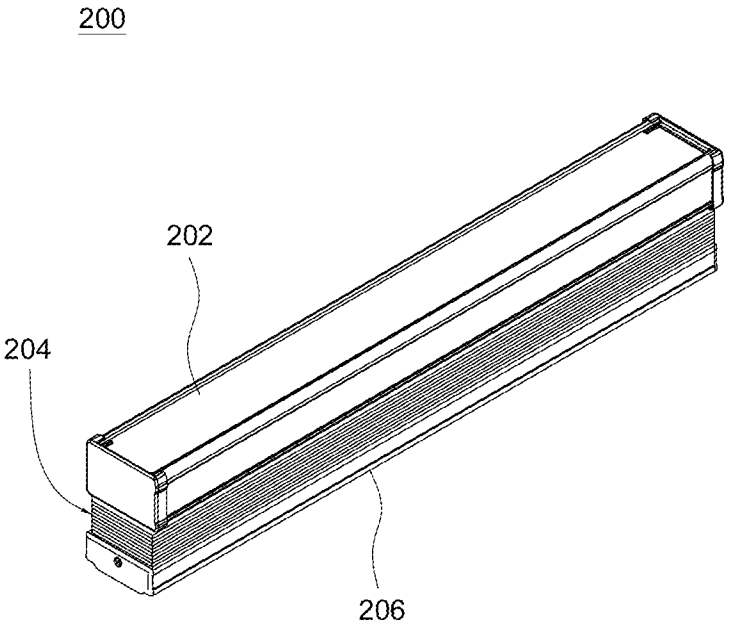
FIG. 10 is a perspective view illustrating the window shade of FIG. 8 with the bottom part held in a fully raised position.

With the aforementioned assembly, the two springs 112 and 114 of the spring drive system 100 are operable to counteract a weight applied on the bottom part 206 for sustaining the bottom part 206 stationary at any desirable height relative to the head rail 202. For example, FIG. 10 exemplary illustrates the window shade 200 with the bottom part 206 held in a fully raised position for collapsing the shading structure 204, FIG. 11 illustrates the window shade 200 with the bottom part 206 held in a lowered position for expanding the shading structure 204.

When the bottom part 206 is in the fully raised position, the two springs 112 and 114 of the spring drive system 100 can be substantially wound around the two spring reels 146 and 148, and apply a biasing force that keeps the bottom part 206 stationary. Moreover, the two suspension cords 120 and 122 can be substantially wound around the cord drums 116 and 118, respectively. This can correspond to the state of the spring drive system 100 illustrated in FIG. 3.

Figure 12:
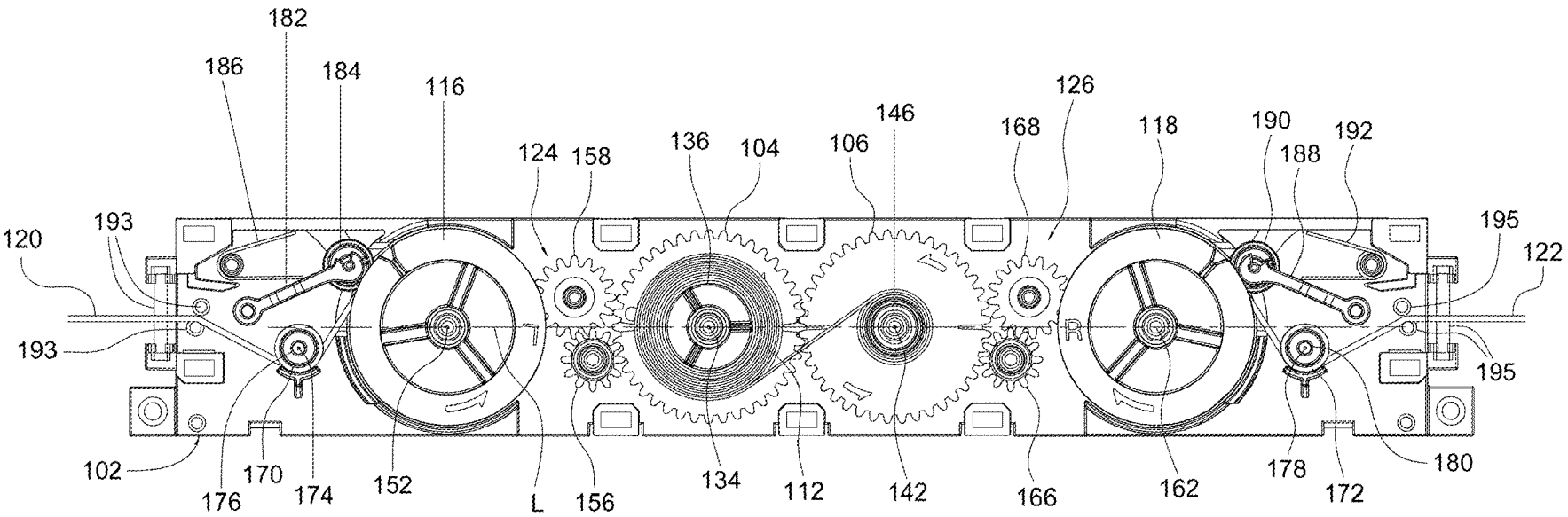
FIG. 12 is a planar view illustrating exemplary operation of the spring drive system in the window shade shown in FIG. 8.

As the bottom part 206 is lowered (e.g., pulled downward by a user), the two suspension cords 120 and 122 can respectively unwind from the cord drums 116 and 118, which rotate along with the gears 104, 106, 108 and 110 and the take-up reels 136 and 138. As a result, the two springs 112 and 114 can respectively unwind from the two spring reels 146 and 148 and wind around the two take-up reels 136 and 138. This can correspond to the state of the spring drive system 100 illustrated in FIG. 12.

When the bottom part 206 moves toward the head rail 202 (e.g., pushed upward by a user), the two springs 112 and 114 can respectively unwind from the two take-up reels 136 and 138 and wind around the two spring reels 146 and 148, and can apply biasing forces that urge the cord drums 116 and 118 to rotate for winding the two suspension cords 120 and 122.

As the bottom part 206 rises toward the head rail 202, the guide rollers 170 and 172 can rotate about and slide along their respective pivot axes 174 and 178, and the springs 186 and 192 can respectively bias the rods 182 and 188 so that the rollers 184 and 190 respectively contact and press the suspension cords 120 and 122 against the cord drums 116 and 118. This can ensure proper positioning and winding of the suspension cords 120 and 122 across the winding surfaces 150 and 160 of the cord drums 116 and 118, which can prevent undesirable tilting of the bottom part 206.

According to the needs, multiple instances of the spring drive system 100 described herein may be incorporated in a window shade. In conjunction with FIGS. 1-7, FIGS. 13-16 are various schematic views illustrating an embodiment of a window shade 200A incorporating two spring drive systems 100A and 100B that respectively have a same construction as the spring drive system 100 described previously. Referring to FIGS. 13-16, the window shade 200A can include the head rail 202, the bottom part 206, an intermediate rail 220 and two shading structures 224 and 226. The intermediate rail 220 is disposed between the head rail 202 and the bottom part 206, and may move relative to the head rail 202 independently from the bottom part 206. The intermediate rail 220 may be fixedly connected with a handle 220A for facilitating its operation.

Figure 13:
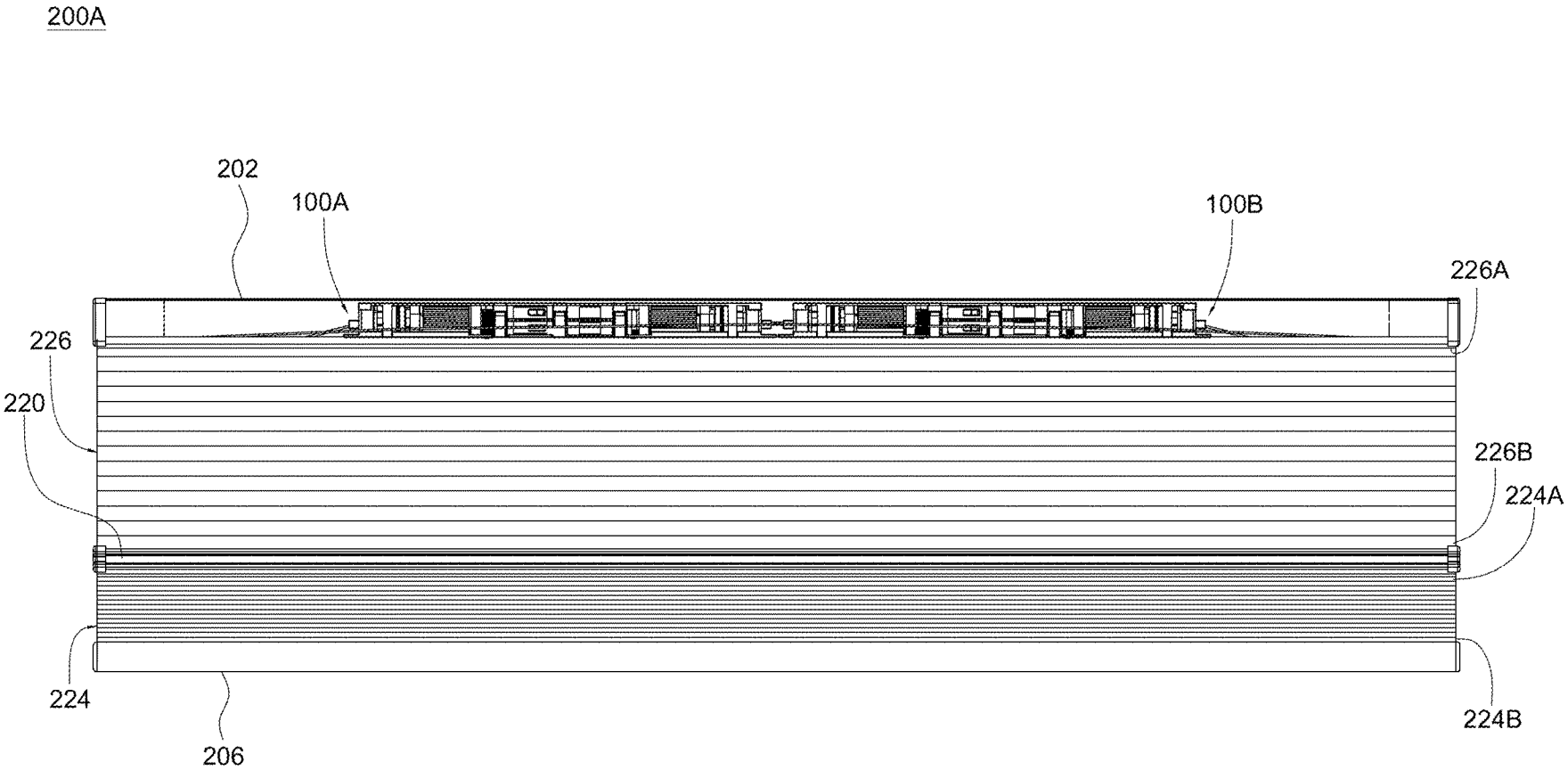
FIG. 13 is front view illustrating an embodiment of a window shade incorporating two spring drive systems that respectively have a same construction as the spring drive system shown in FIGS. 1-5.
Figure 14:
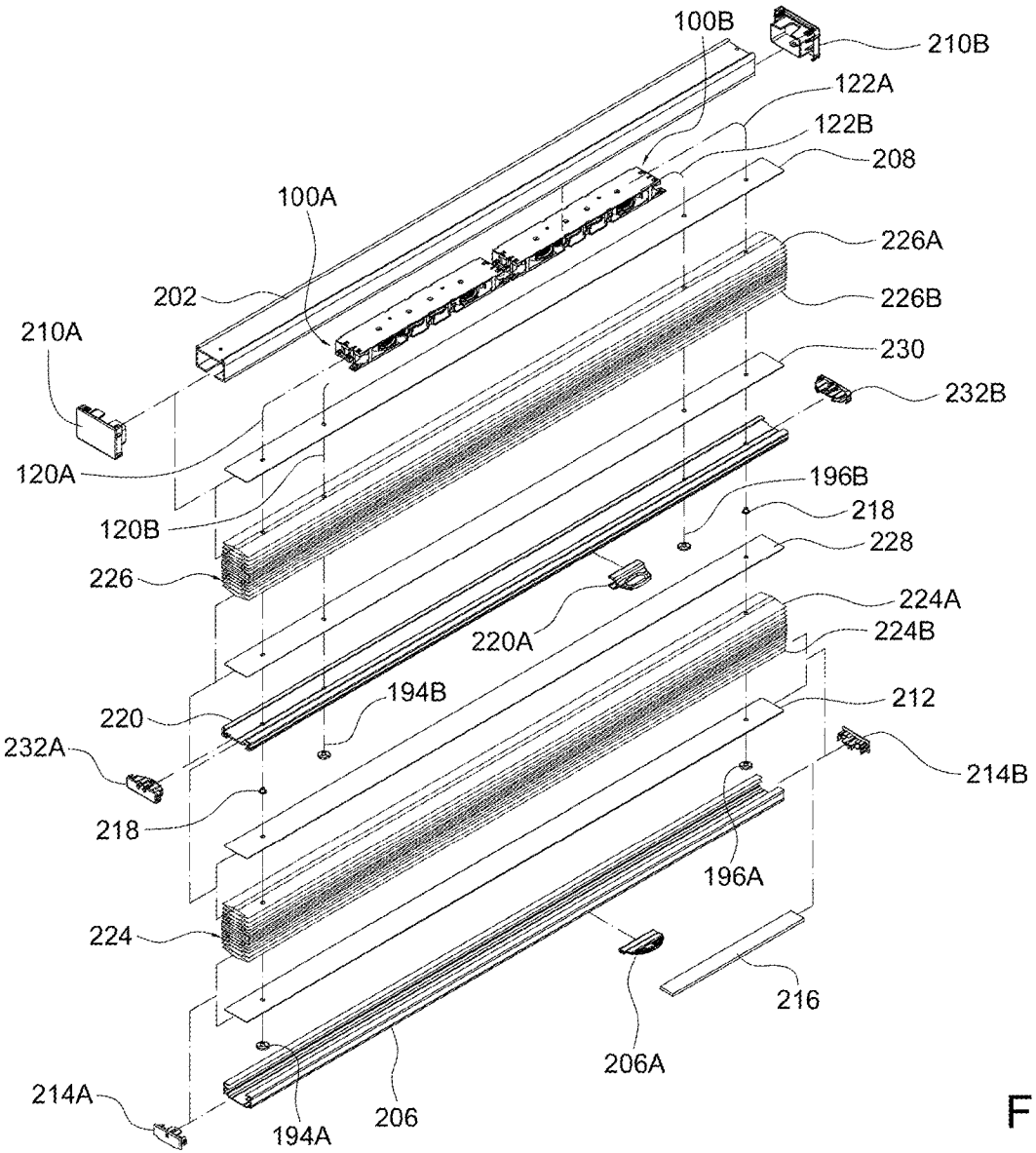
FIG. 14 is an exploded view of the window shade shown in FIG. 13.

Referring to FIGS. 13 and 14, the two shading structures 224 and 226 may exemplary have honeycomb structures. The shading structure 224 is disposed between the intermediate rail 220 and the bottom part 206, and has two opposite ends 224A and 224B respectively disposed adjacent to the intermediate rail 220 and the bottom part 206. For example, the end 224A of the shading structure 224 may be provided with a strip 228 that is engaged with the intermediate rail 220 so as to attach the end 224A of the shading structure 224 to the intermediate rail 220, and the other end 224B of the shading structure 224 may be likewise attached to the bottom part 206 via the strip 212.

The shading structure 226 is disposed between the head rail 202 and the intermediate rail 220, and has two opposite ends 226A and 226B respectively disposed adjacent to the head rail 202 and the intermediate rail 220. For example, the end 226A of the shading structure 226 may be provided with the strip 208 that is engaged with the head rail 202 so as to attach the end 226A of the shading structure 226 to the head rail 202, and the other end 226B of the shading structure 226 may be likewise attached to intermediate rail 220 via a strip 230. Two end caps 232A and 232B may respectively close two opposite ends of the intermediate rail 220 so as to restrain the strips 228 and 230 inside the intermediate rail 220.

In conjunction with FIGS. 13 and 14, FIGS. 17 and 18 are two planar views illustrating the two spring drive systems 100A and 100B applied in the window shade 200A. Referring to FIGS. 13, 14, 17 and 18, the spring drive systems 100A and 100B have the same construction as the spring drive system 100 described previously. Reference numbers 120A and 122A designate the two suspension cords that are respectively connected with the two cord drums 116 and 118 in the spring drive system 100A, and reference numbers 120B and 122B designate the two suspension cords that are respectively connected with the two cord drums 116 and 118 in the spring drive system 100B. The respective housings 102 of the spring drive systems 100A and 100B can be disposed adjacent to each other and affixed to the head rail 202 of the window shade 200A, the suspension cords 120A and 122A of the spring drive system 100A can be coupled to the bottom part 206, and the suspension cords 120B and 122B of the spring drive system 100B can be coupled to the intermediate rail 220. More specifically, the two suspension cords 120A and 122A can have respective distal ends 194A and 196A affixed to the bottom part 206, and the two suspension cords 120B and 122B can have respective distal ends 194B and 196B affixed to the intermediate rail 220. According to an example of construction, one of the two suspension cords 120A and 122A (e.g., the suspension cord 122A) of the spring drive system 100A may be routed through the housing 102 of the spring drive system 100B, and one of the two suspension cords 120B and 122B (e.g., the suspension cord 120B) of the spring drive system 100B may be routed through the housing 102 of the spring drive system 100A. The two suspension cords 120A and 120B can exit the housing 102 of the spring drive system 100A from a same end thereof, and the two suspension cords 122A and 122B can exit the housing 102 of the spring drive system 100B from a same end thereof opposite to the side of the two suspension cords 120A and 120B.

Referring to FIGS. 13-18, the two springs 112 and 114 of the spring drive system 100A are operable to counteract a weight applied on the bottom part 206 of the window shade 200A for sustaining the bottom part 206 stationary at any desirable position relative to the head rail 202. The two springs 112 and 114 of the spring drive system 100B are operable to counteract a weight applied on the intermediate rail 220 for sustaining the intermediate rail 220 stationary at any desirable position relative to the head rail 202. Moreover, the two springs 112 and 114 and the two cord drums 116 and 118 of the spring drive system 100A are operable independently from the two springs 112 and 114 and the two cord drums 116 and 118 of the spring drive system 100B.

Figure 15:
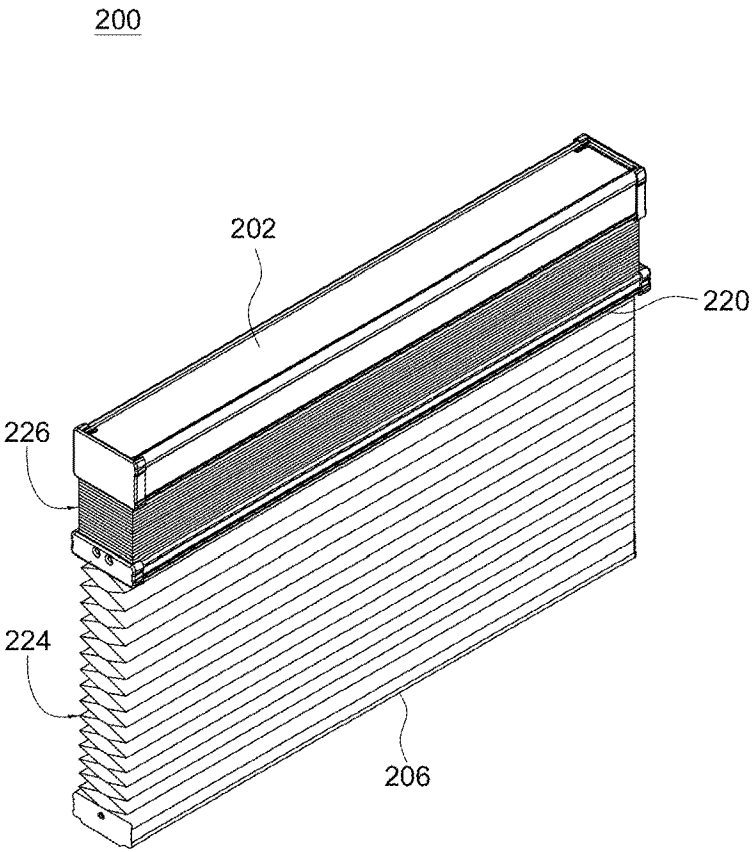
FIG. 15 is a perspective view illustrating the window shade shown in FIG. 13 with the bottom part lowered relative to the head rail and the intermediate rail.
Figure 17:
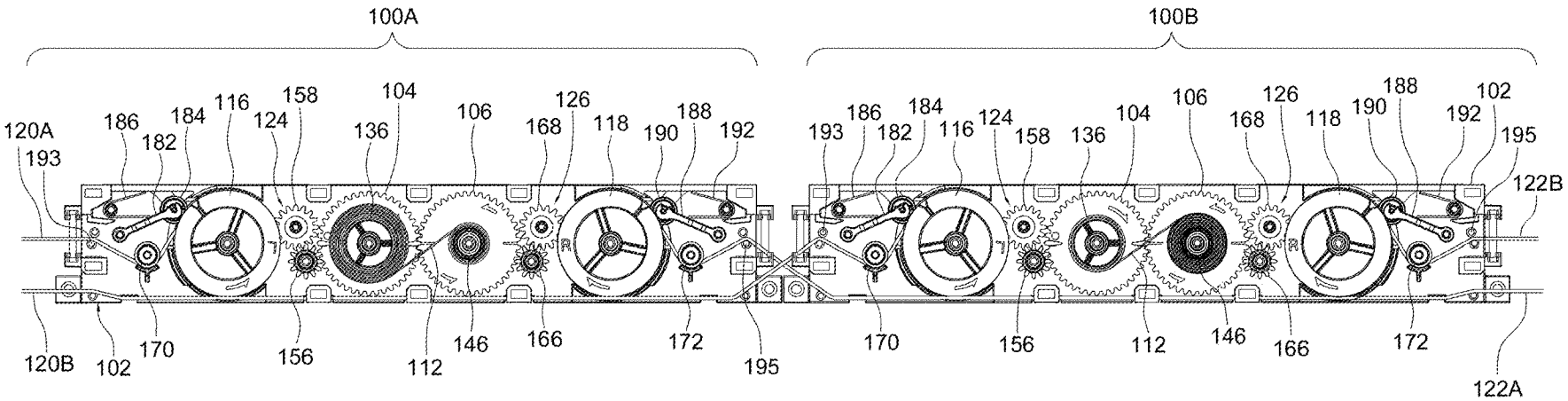
FIG. 17 is a planar view illustrating exemplary operation of one of the two spring drive systems in the window shade shown in FIG. 13.

When the bottom part 206 of the window shade 200A moves relative to the head rail 202 and the intermediate rail 220 while the intermediate rail 220 remains stationary, only the components of the spring drive system 100A move while those of the spring drive system 100B remain stationary. For example, when the bottom part 206 lowers relative to the head rail 202 and the intermediate rail 220 for expanding the shading structure 224 as shown in FIG. 15, the two suspension cords 120A and 122A of the spring drive system 100A can respectively unwind from the two cord drums 116 and 118 of the spring drive system 100A, which rotate along with the gears 104, 106, 108 and 110 and the take-up reels 136 and 138 of the spring drive system 100A. As a result, the two springs 112 and 114 of the spring drive system 100A can respectively unwind from the two spring reels 146 and 148 of the spring drive system 100A and wind around the two take-up reels 136 and 138 of the spring drive system 100A. FIG. 17 exemplary illustrates the spring drive systems 100A and 100B corresponding to a state where the bottom part 206 of the window shade 200A is in a lowered position and the intermediate rail 220 is in an initial position closer to the head rail 202.

When the bottom part 206 moves toward the intermediate rail 220 for collapsing the shading structure 224, the two springs 112 and 114 of the spring drive system 100A can respectively unwind from the two take-up reels 136 and 138 of the spring drive system 100A and wind around the two spring reels 146 and 148 of the spring drive system 100A, and can apply a biasing force that urges the two cord drums 116 and 118 of the spring drive system 100A to rotate for winding the two suspension cords 120A and 122A. Meanwhile, the cord drums 116 and 118, the gears 104, 106, 108 and 110 and the springs 112 and 114 of the spring drive system 100B can remain stationary, because the intermediate rail 220 does not move and remains in position relative to the head rail 202.

Figure 16:
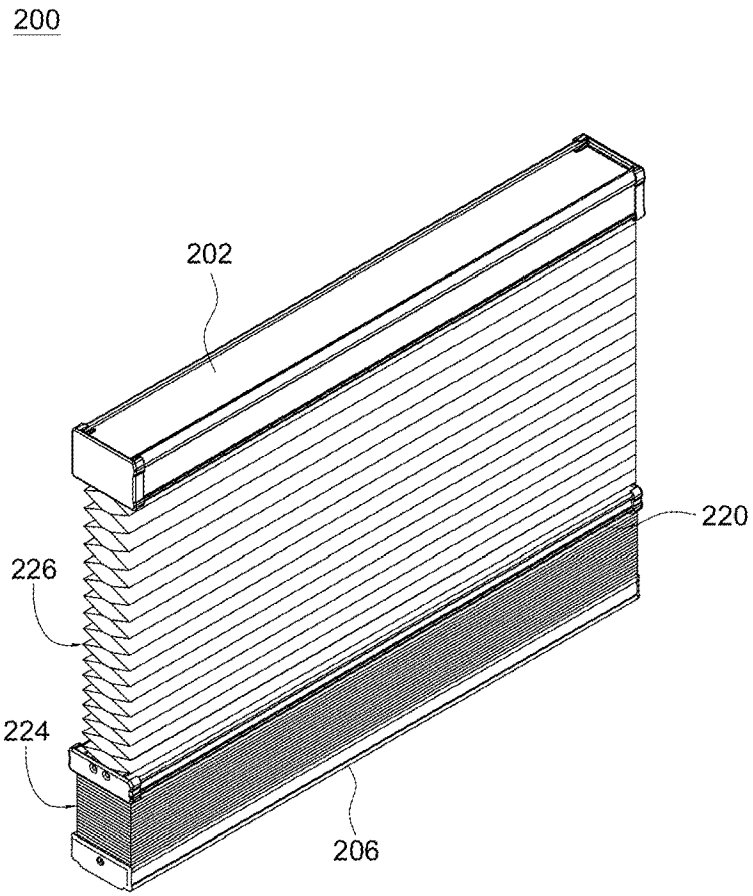
FIG. 16 is a perspective view illustrating the window shade shown in FIG. 13 with the intermediate rail lowered relative to the head rail.
Figure 18:
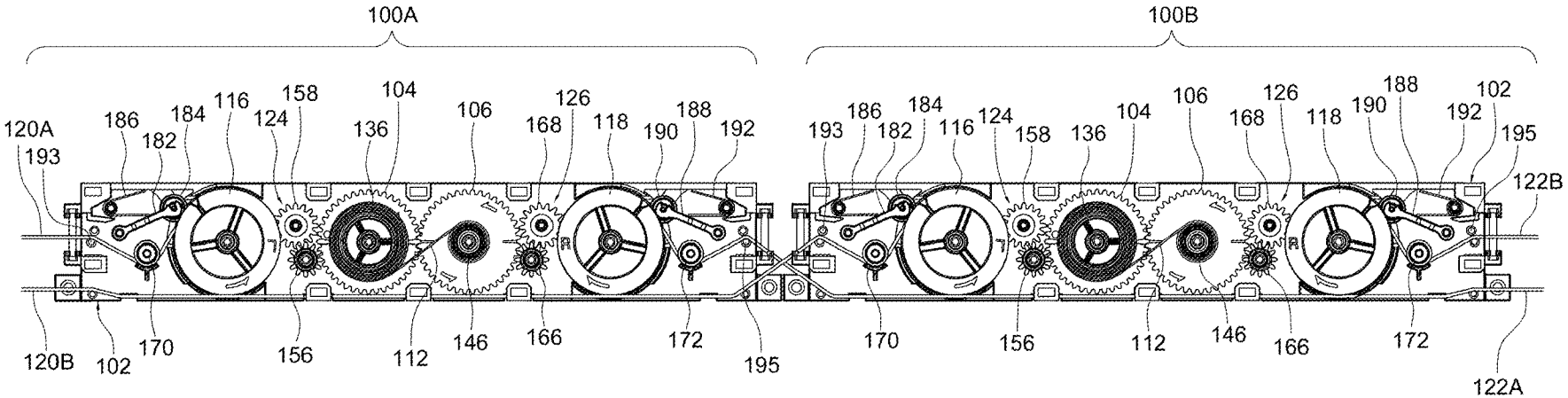
FIG. 18 is a planar view illustrating exemplary operation of the other one of the two spring drive systems in the window shade shown in FIG. 13.

When the intermediate rail 220 moves relative to the head rail 202 and the bottom part 206 while the bottom part 206 remains stationary, only the components of the spring drive system 100B move while those of the spring drive system 100A remain stationary. For example, when the intermediate rail 220 moves away from the head rail 202 to a lowered position for expanding the shading structure 226 as shown in FIG. 16, the two suspension cords 120B and 122B of the spring drive system 100B can respectively unwind from the two cord drums 116 and 118 of the spring drive system 100B, which rotate along with the gears 104, 106, 108 and 110 and the take-up reels 136 and 138 of the spring drive system 100B. As a result, the two springs 112 and 114 of the spring drive system 100B can respectively unwind from the two spring reels 146 and 148 of the spring drive system 100B and wind around the two take-up reels 136 and 138 of the spring drive system 100B. FIG. 18 exemplary illustrates the spring drive systems 100A and 100B corresponding to a state where the intermediate rail 220 of the window shade 200A is moved from an initial position to a lowered position.

When the intermediate rail 220 moves toward the head rail 202 for collapsing the shading structure 226, the two springs 112 and 114 of the spring drive system 100B can respectively unwind from the two take-up reels 136 and 138 of the spring drive system 100B and wind around the two spring reels 146 and 148 of the spring drive system 100B, and can apply a biasing force that urges the two cord drums 116 and 118 to rotate for winding the two suspension cords 120B and 122B. Meanwhile, the cord drums 116 and 118, the gears 104, 106, 108 and 110 and the springs 112 and 114 of the spring drive system 100A can remain stationary, because the bottom part 206 does not move and remains in position relative to the head rail 202.

Figure 19:
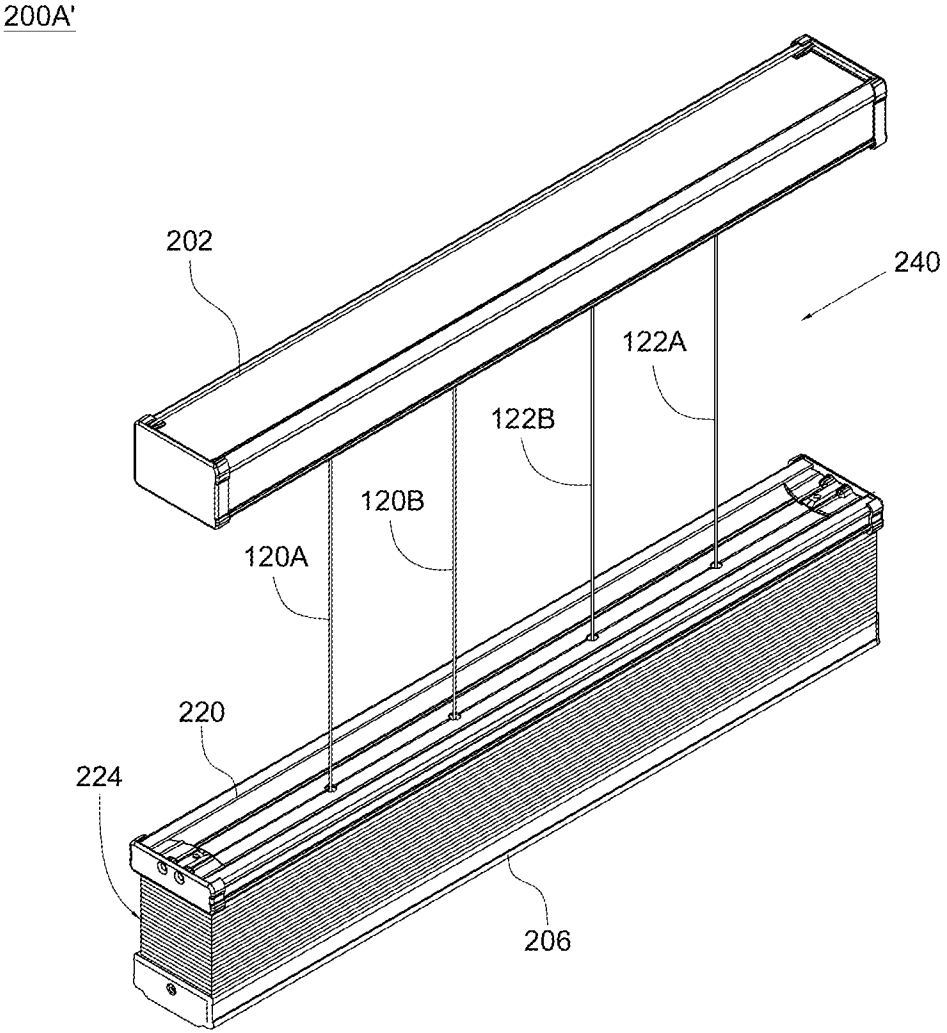
FIG. 19 is a perspective view illustrating a variant embodiment of the window shade shown in FIG. 13.

Although the window shade 200A has been described as including two shading structures 224 and 226, it will be appreciated that other embodiments may have only one of the two shading structures 224 and 226. For example, FIG. 19 is a perspective view illustrating a variant embodiment of a window shade 200A' that is similar to the window shade 200A described previously except that the shading structure 226 between the head rail 202 and the intermediate rail 220 is omitted. Referring to FIG. 19, the intermediate rail 220 of the window shade 200A' can move downward relative to the head rail 202 to create a gap 240 between the head rail 202 and the intermediate rail 220 for light passage, and can move upward to a position adjacent to the head rail 202 to close the gap 240 between the head rail 202 and the intermediate rail 220. The window shade 200A' shown in FIG. 19 can incorporate the same spring drive systems 100A and 100B described previously, which can operate in a similar manner.

The spring drive systems described herein are relatively simple in construction, have a compact size, and can be conveniently expanded or combined according to the type or size of a window shade.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A spring drive system for a window shade, comprising:

a housing;

a first and a second gear respectively connected pivotally with the housing about a first and a second pivot axis, the first and second gears being engaged with each other, the first gear being fixedly connected with a first and a second take-up reel at two opposite sides of the first gear;

a first and a second spring respectively assembled at two opposite sides of the second gear around the second pivot axis, the first spring having an end anchored with the first take-up reel, and the second spring having an end anchored with the second take-up reel;

a first cord drum and a third gear fixedly connected with each other and pivotally connected with the housing about a third pivot axis, the first cord drum being connected with a first suspension cord;

a first gear train respectively engaged with the first gear and the third gear, the first gear and the third gear being respectively located at different levels along the first and third pivot axes so that a position of the first gear along the first pivot axis does not overlap with a position of the third gear along the third pivot axis;

a second cord drum and a fourth gear fixedly connected with each other and pivotally connected with the housing about a fourth pivot axis, the second cord drum being connected with a second suspension cord; and a second gear train respectively engaged with the second gear and the fourth gear, the second gear and the fourth gear being respectively located at different levels along the second and fourth pivot axes so that a position of the second gear along the second pivot axis does not overlap with a position of the fourth gear along the fourth pivot axis.

2. The spring drive system according to claim 1, wherein the first cord drum has a winding surface for winding the first suspension cord that extends between two axially opposite protruding edges of the first cord drum, and the first gear is located within an extent of the winding surface between the two protruding edges.

3. The spring drive system according to claim 1, wherein the first gear train includes a fifth and a sixth gear engaged with each other, the fifth gear further being engaged with the first gear, and the sixth gear further being engaged with the third gear.

4. The spring drive system according to claim 3, wherein the fifth and sixth gears have different face widths.

5. The spring drive system according to claim 1, wherein the first gear, the first gear train and the third gear are configured so that the first cord drum and the first and second take-up reels have a same rotational speed, or are configured to impart a rotational speed difference between the first cord drum and the first and second take-up reels.

6. The spring drive system according to claim 1, further including a first and a second spring reel respectively connected pivotally at two opposite sides of the second gear so that the first and second spring reels are respectively rotatable relative to the second gear, the first and second spring reels and the second gear being disposed in a coaxial manner, the first spring being assembled around the first spring reel, and the second spring being assembled around the second spring reel.

7. The spring drive system according to claim 1, further including a guide roller pivotally connected with the housing about a fifth pivot axis, the first suspension cord wrapping at least partially around the guide roller.

8. The spring drive system according to claim 7, wherein the guide roller is slidable along the fifth pivot axis to facilitate winding of the first suspension cord around the first cord drum.

9. The spring drive system according to claim 1, further including a rod that is pivotally connected with the housing and carries a roller in contact with the first suspension cord, and a spring connected with the rod, the spring biasing the rod in a direction for pressing the first suspension cord against the first cord drum.

10. A window shade comprising:

a head rail and a bottom part;

a shading structure having a first and a second end respectively disposed adjacent to the head rail and the bottom part; and the spring drive system according to claim 1, the housing of the spring drive system being affixed to one of the head rail and the bottom part, the first and second suspension cords having ends affixed to the other one of the head rail and the bottom part, the first and second springs of the spring drive system being operable to counteract a weight applied on the bottom part for sustaining the bottom part.

11. A window shade comprising:

a head rail, a bottom part, and an intermediate rail between the head rail and the bottom part;

a shading structure having a first and a second end respectively disposed adjacent to the intermediate rail and the bottom part; and the spring drive system according to claim 1, the housing of the spring drive system being affixed to the head rail, the first and second suspension cords having ends affixed to the intermediate rail;

wherein the first and second springs respectively wind around the first and second take-up reels when the intermediate rail moves away from the head rail, and the first and second springs bias the first and second cord drums to rotate for respectively winding the first and second suspension cords when the intermediate rail moves toward the head rail.

12. A spring drive system for a window shade, comprising:

a housing;

a first and a second gear respectively connected pivotally with the housing about a first and a second pivot axis, the first and second gears being engaged with each other, the first gear being fixedly connected with a first and a second take-up reel at two opposite sides of the first gear;

a first and a second spring respectively assembled at two opposite sides of the second gear around the second pivot axis, the first spring having an end anchored with the first take-up reel, and the second spring having an end anchored with the second take-up reel;

a first cord drum and a third gear fixedly connected with each other and pivotally connected with the housing about a third pivot axis, the first cord drum being connected with a first suspension cord and having a winding surface where the first suspension cord is wound that extends between two axially opposite protruding edges of the first cord drum, the first and second gears being located within an extent of the winding surface between the two protruding edges, and the extent of the winding surface overlapping with an extent of the first spring and an extent of the second spring along a direction parallel to the second pivot axis and the third pivot axis;

a first gear train respectively engaged with the first gear and the third gear;

a second cord drum and a fourth gear fixedly connected with each other and pivotally connected with the housing about a fourth pivot axis, the second cord drum being connected with a second suspension cord; and a second gear train respectively engaged with the second gear and the fourth gear.

13. The spring drive system according to claim 12, wherein the first gear train includes a fifth and a sixth gear engaged with each other, the fifth gear further being engaged with the first gear, and the sixth gear further being engaged with the third gear.

14. The spring drive system according to claim 12, wherein the first gear, the first gear train and the third gear are configured so that the first cord drum and the first and second take-up reels have a same rotational speed, or are configured to impart a rotational speed difference between the first cord drum and the first and second take-up reels.

15. The spring drive system according to claim 12, further including a first and a second spring reel respectively connected pivotally at two opposite sides of the second gear so that the first and second spring reels are respectively rotatable relative to the second gear, the first and second spring reels and the second gear being disposed in a coaxial manner, the first spring being assembled around the first spring reel, and the second spring being assembled around the second spring reel.

16. The spring drive system according to claim 12, further including a guide roller pivotally connected with the housing about a fifth pivot axis, the first suspension cord wrapping at least partially around the guide roller.

17. The spring drive system according to claim 16, wherein the guide roller is slidable along the fifth pivot axis to facilitate winding of the first suspension cord around the first cord drum.

18. The spring drive system according to claim 12, further including a rod that is pivotally connected with the housing and carries a roller in contact with the first suspension cord, and a spring connected with the rod, the spring biasing the rod in a direction for pressing the first suspension cord against the first cord drum.

19. A window shade comprising:

a head rail and a bottom part;

a shading structure having a first and a second end respectively disposed adjacent to the head rail and the bottom part; and the spring drive system according to claim 12, the housing of the spring drive system being affixed to one of the head rail and the bottom part, the first and second suspension cords having ends affixed to the other one of the head rail and the bottom part, the first and second springs of the spring drive system being operable to counteract a weight applied on the bottom part for sustaining the bottom part.

20. A window shade comprising:

a head rail, a bottom part, and an intermediate rail between the head rail and the bottom part;

a shading structure having a first and a second end respectively disposed adjacent to the intermediate rail and the bottom part; and the spring drive system according to claim 12, the housing of the spring drive system being affixed to the head rail, the first and second suspension cords having ends affixed to the intermediate rail;

wherein the first and second springs respectively wind around the first and second take-up reels when the intermediate rail moves away from the head rail, and the first and second springs bias the first and second cord drums to rotate for respectively winding the first and second suspension cords when the intermediate rail moves toward the head rail.

* * * * *